US005796367A

United States Patent [19]

Andersson

[11] Patent Number: 5,796,367

[45] Date of Patent: Aug. 18, 1998

[54] DEVICE FOR ANTENNA UNITS

[75] Inventor: Christer Andersson, Mölndal, Sweden

[73] Assignee: Telefonaktiebolaget LM Ericsson, Sweden

[21] Appl. No.: 722,879

[22] Filed: Sep. 26, 1996

[30] Foreign Application Priority Data

Sep. 29, 1995 [SE] Sweden ..... 9503391

[51] Int. Cl.[6] ..... H01Q 1/38; H01Q 1/48

[52] U.S. Cl. ..... 343/700 MS; 343/846; 343/848

[58] Field of Search ..... 343/700 MS, 846, 343/848, 829, 845, 847; H01Q 1/38, 1/48

[56] References Cited

U.S. PATENT DOCUMENTS 2,998,605 8/1961 Orlando ..... 343/848

4,635,065 1/1987 Mori et al. ..... 343/700 MS 5,132,698 7/1992 Swineford ..... 343/846

5,448,249 9/1995 Kushihi et al. ..... 343/700 MS 5,589,842 12/1996 Wang et al. ..... 343/700 MS

*Primary Examiner*—Hoanganh T. Le

*Attorney, Agent, or Firm*—Burns, Doane, Swecker & Mathis, L.L.P.

[57] ABSTRACT

Device for antenna units (1) consisting of one or more radiation elements (4) for transmission and reception, respectively, of electromagnetic signals. The antenna unit (1) presents two ground planes arranged at different, predetermined ground plane distances.

3 Claims, 3 Drawing Sheets

DEVICE FOR ANTENNA UNITS

BACKGROUND

The present invention relates to a device for antenna units in particular antenna units including a plurality of radiation elements for transmission and reception of electromatic signals having a ground plane arranged at a distance from the radiation elements.

In the field of design of antennas for electromagnetic signals and provided with ground planes, the distance between the radiation elements of the antenna and the ground plane is decisive as regards the gain and bandwidth of the antenna. Furthermore, the radiating power from each radiation element of the antenna depends on the dimensions of the radiation elements. A feeding network with connectors up to each radiation element is arranged for the purpose of feeding the radiation elements. As regards antennas for both horizontal and vertical polarization, separate feeding networks are provided, which consequently means that more connectors are connected to the radiation elements. Even though the only purpose of the connectors is to distribute electromagnetic energy supplied to the antenna, the connectors emit a certain amount of radiation, which leads to power losses and which also influences the radiation diagram of the antenna in a negative manner.

Up to now, it has been necessary to dimension the feeding network with a physical length which is greater than the distance between the feeding points of the radiation elements, since each radiation element should be fed with a certain phase and since the signal has different phase velocities at corresponding connector widths. So far, it has been a problem to limit the radiation from the feeding network, since the radiated output power increases with increased dimensions of the feeding network, as is also the case of the radiation elements.

SUMMARY OF THE INVENTION

The object of the present invention is to provide a device for antenna units by means of which the radiation from predetermined parts of the antenna unit is limited.

Said object is accomplished by means of a device for antenna units according to the present invention, the features of which are described in greater detail below.

In accordance with the invention, different ground planes are arranged in different parts of the antenna unit, something which decreases unwanted radiation from selected parts of the antenna unit.

BRIEF DESCRIPTION OF THE DRAWINGS

The invention will be described in greater detail in the following with reference to several embodiments and the annexed drawings, in which.

DETAILED DESCRIPTION

Figure 1:
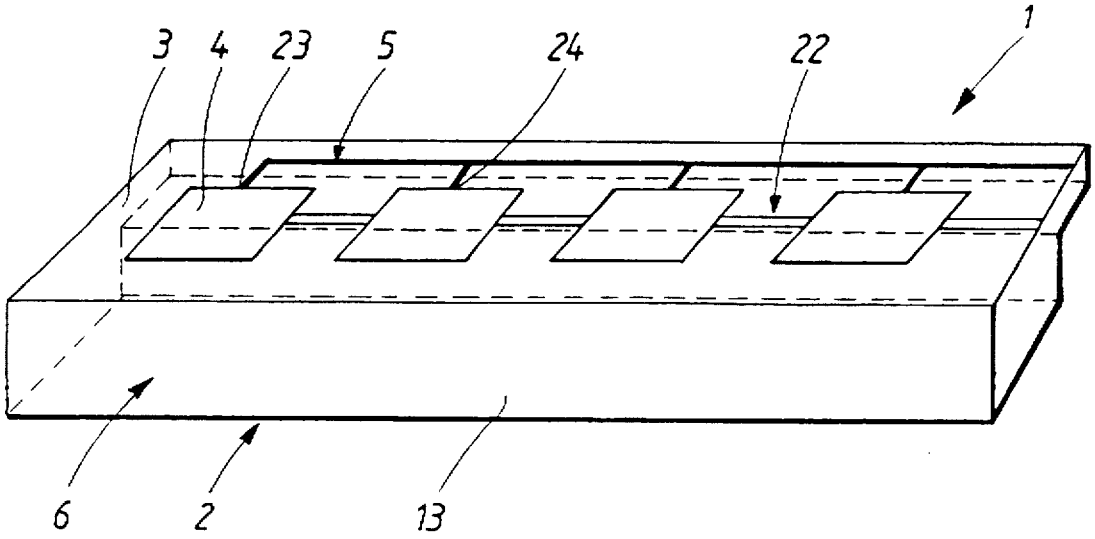
FIG. 1 shows a perspective view of an antenna unit according to the present invention, according to a first embodiment.
Figure 2:
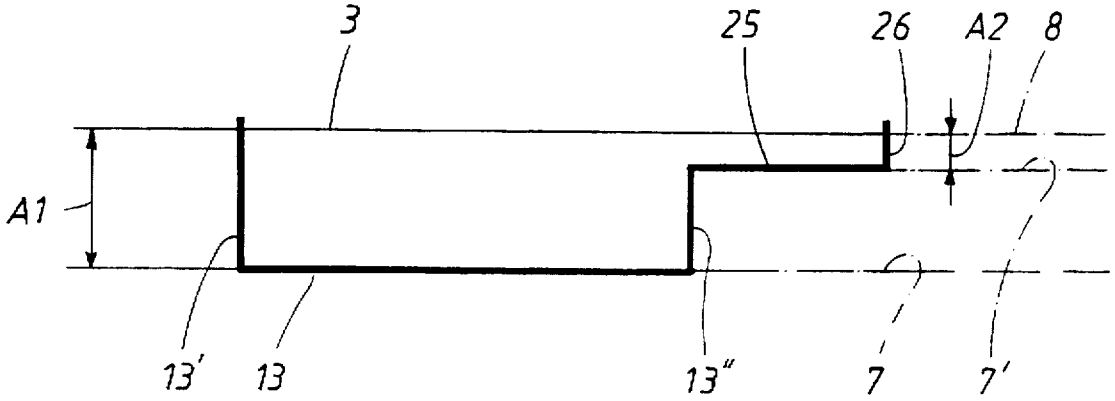
FIG. 2 shows a schematical end view of the antenna unit according to FIG. 1.

FIGS. 1 and 2 thus show very schematically an antenna unit 1 for electromagnetic radiation according to a first embodiment and consisting of a support structure 2, which comprises a plate-shaped support 3 of an electrically insulating material, for example a board of relatively stiff material, for example a glass-fibre laminated material or a polymer material, which supports an electrically conductive layer forming a circuit pattern which for example is formed by etching a copper laminate, i.e. a board of the PC-plate type or a printed circuit board. The insulating board 3 supports a plurality of radiation elements 4 which are flat, i.e. which extend in a plate-shaped manner and which for example are of the micro-strip antenna type intended for micro-base stations in the field of mobile telephones. Consequently, in the shown example the antenna operates in the microwave range, i.e. in the magnitude of approximately 1 GHz or higher. Using the same technology, supply connectors 5 are also provided for the antenna elements. For example, the radiated output signal may be polarized with a horizontal or vertical polarization, or may present both types of polarizations.

Furthermore, the support structure 2 comprises an electrically conductive part 6 which is designed as a casing and which thus forms a mechanical protective element as well as an electrical shield. The shielding function also implies that the electrically conductive part 6 defines a first ground plane 7 forming part of the antenna unit 1 and extending parallel to the main plane 8 of the radiation elements 4, i.e. essentially parallel to the plane of the support laminate 3. The ground plane 7 will be described in greater detail below. Its extension in the plane 7 is delimited by two side sections 13' which project from a base section 13 and which support the support 3 for the radiation elements 4.

The antenna unit 1 can be adapted for only one type of polarization or for different polarizations as regards both the transmitted and the received signal. In the shown example, the antenna is intended for use for both horizontal and vertical polarization and presents, besides the above-mentioned feeding network 5 which is intended for example for horizontal polarization, also a second feeding network 22 intended for vertical polarization. Since each radiation element 4 is to be supplied with a certain phase, the electrical length of the feeding network must be correctly adapted, in particular so that the electrical length equals a wavelength between the feeding points 23, 24 of each radiation element 4. In this regard and in order to reduce the unwanted radiation of the feeding network, it is desirable that the physical length of the connectors be kept as short as possible, preferably as in the shown example according to FIG. 1 having straight conductors. In accordance with the invention, this has been solved by arranging a second ground plane 7' opposite predetermined parts of the antenna unit, which parts do not form the radiation elements 4 but instead, for example, the feeding networks or at least the feeding network 5. The second ground plane 7' has been chosen as having a ground plane distance A2 which is less than A1. In this manner, the phase velocity in the feeding network is reduced, which enables the physical length of the feeding network to be shortened. The electromagnetic field from the feeding network will be connected more tightly to the short ground plane distance, thus further decreasing the radiation out of the feeding network and decreasing the disturbance of the antenna's radiation diagram. According to a basic design which is shown schematically in the first embodiment, the two different ground planes 7, 7' can be arranged in such a manner that the base section 13 is gradually transformed with one of its wall sections 13' into a raised base part 25, which may extend along a limited section of the width of the antenna unit, but for example along its entire length and which can merge into a wall section 26 by means of which the insulating support 3 for the radiation elements and the feeding networks is supported.

Figure 3:
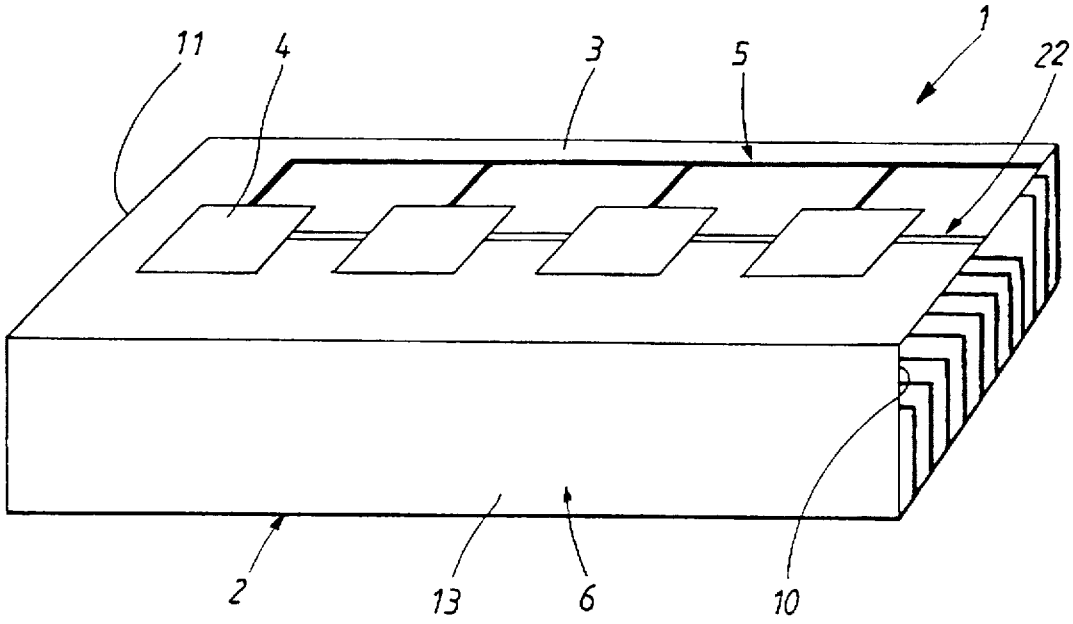
FIG. 3 shows a schematical perspective view of the antenna unit according to a second embodiment.
Figure 4:
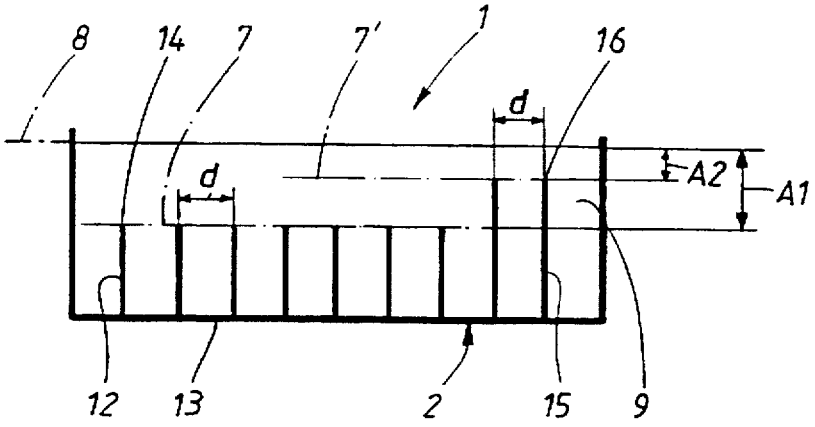
FIG. 4 shows a schematic end view of the antenna unit according to FIG. 3.

FIGS. 3 and 4 show a second embodiment of the antenna unit 1 from which it will be apparent that different ground plane distances A1 and A2, and consequently different ground planes 7, 7', can be designed in a manner which is different from that shown in FIGS. 1 and 2.

The antenna unit 1 is normally exposed to different heat sources. When arranged outdoors, solar radiation towards the radiation elements (the patches) or the surrounding radome may for example lead to a rise in temperature. This implies that heat must be carried away if the unit is to be able to operate under advantageous temperature conditions. Furthermore, the antenna unit may support energy-demanding electronic components which consequently emit heat which must be carried away. To this end, a cavity 9 is arranged between the support 3 for the radiation elements and the electrically conductive and supporting structure 6, which cavity is adapted to allow a flow of cooling air therethrough. To this end, the cavity presents an inlet 10 in one end of the antenna unit 1 and an outlet 11 in the opposite end of the unit. The flow of air through the cavity is provided by means of a fan or by means of self-circulation, for example due to the fact that the antenna unit 2 is arranged vertically, having for example the inlet 10 arranged in a lower region of the unit and the outlet 11 arranged in an upper region of the unit. In order to increase the heat-emitting surface, the support structure 6 is designed with a plurality of cooling flanges 12 which extend from the base section 13, forming a rear wall in the support structure and terminating with a longitudinally extending edge section 14 which extends essentially parallel to the main plane 8 of the radiation elements 4.

In order to obtain the required cooling, the air cavity 9 must be of such dimensions, i.e. of such cross-sectional area, that the flow of air becomes sufficiently high. Otherwise, the air will be thermically insulating. Also, it is desired to obtain a high coefficient of efficiency of the antenna and a predetermined bandwidth, which parameters are dependent on the distance of the radiation elements or antenna elements 4 to the ground plane 7. Furthermore, for the purpose of satisfying the demand for adequate cooling and adequate electrical properties of the antenna, the intermediate distance according to the invention between the cooling flanges 12 has been chosen to be so small that the edge sections 14 or peaks of the cooling flanges together define the ground plane 7 and consequently raise the ground plane from the base section 13 to the plane 7. Necessary for the flange peaks to form ground planes is that the distance d of the cooling flanges preferably is lower than 0.25 λ, for example approximately 0.1 λ, where λ is the wavelength of the signal radiating out from the antenna elements 4. If this condition is satisfied, one of the ground plane distances is thus transferred to a suitably chosen distance A1.

FIGS. 3 and 4 show a second embodiment of the antenna unit 1, from which it is apparent that different ground planes A1 and A2, and consequently different ground planes 7, 7', may be present in the same antenna unit. In the shown example, this is obtained by arranging a second group of cooling flanges 15 with edge sections 16 along a section of the support structure 6. The edge sections 16 extend essentially parallel to the antenna plane 8, but at a distance from the radiation elements 4 which is different from the edge sections 14. These flanges 15 should also fulfill the requirement as regards the interspace between the flanges 15, i.e. preferably d<0.25 λ, for example approximately 0.1 λ. It may be desirable to choose a smaller ground plane distance A2 along a section which is situated behind the feeding connectors 17 to the antenna elements 4, so that said elements radiate as little as possible.

Figure 5:
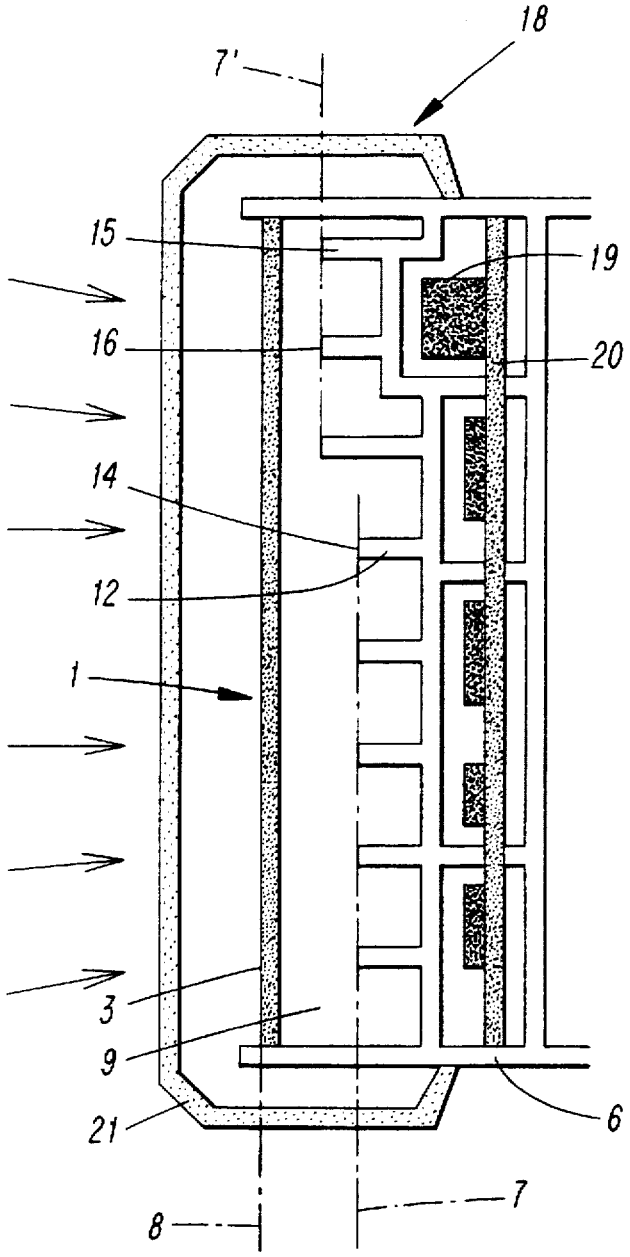
FIG. 5 shows an end view of an electronics unit according to the invention and comprising an antenna unit according to a third embodiment.

FIG. 5 shows a view from above of an electronics unit 18 which comprises the antenna unit 1 and also supports a number of electronic components 19 supported on a support 20, such as a printed circuit board. The electronic components 19 are arranged in a cavity behind the air cavity 9 between the support 3 for the antenna elements and the electrically conductive and shielding part 6 of the support structure, which for example is manufactured from an extruded aluminum profile. A radome 21, which forms an environmental protection element for the antenna unit 1, connects to the support structure 6. The radome is also permeable to electromagnetic radiation.

The antenna unit 1 is usually used as a combined transmitter and receiver antenna, the antenna being completely reciprocal as regards its properties.

The invention is not limited to the embodiments described above and shown in the drawings, but may be varied within the scope of the appended claims. For example, the cooling flanges 12, 15 within each section may present different heights. For example, every second flange may be longer than the adjacent flange. However, the condition regarding interspaces between the peaks of the flanges must still be satisfied. More than one, two, three or more ground planes can be arranged in the same antenna unit by means of further sections having different flange heights.

I claim:

1. Device for an antenna unit comprising one or more radiation elements for transmission and reception, respectively, of electromagnetic signals and a ground plane arranged at a distance from said one or more radiation elements, wherein the antenna unit presents at least two ground planes arranged at distinct, predetermined ground plane distances in which the antenna unit presents at least one feeding network having feeding connectors for feeding the radiation elements, and a first ground plane is positioned at a predetermined, first ground plane distance behind the radiation elements, and that a second ground plane is positioned at a predetermined, second ground plane distance behind at least a part of said feeding network.

2. Device according to claim 1, wherein a plurality of cooling flanges, presenting an intermediate distance which is smaller than 0.25 λ of the signal transmitted and received, respectively, by the radiation elements, extend at a predetermined distance to said radiation element, whereby the edge sections of the cooling flanges which face the radiation elements together define said ground plane wherein λ is the wavelength of the signal radiating out from the antenna elements.

3. Device according to claim 2, wherein the intermediate distance between the cooling flanges is approximately 0.1 λ.

* * * * *